US005285536A

United States Patent [19]

Long

[11] Patent Number: 5,285,536

[45] Date of Patent: Feb. 15, 1994

[54] WAVE GENERATING SYSTEM

[76] Inventor: Arthur Long, 49 Ida St., Troy, N.Y. 12180

[21] Appl. No.: 931,406

[22] Filed: Aug. 21, 1992

Related U.S. Application Data

[63] Continuation-in-part of Ser. No. 749,134, Aug. 26, 1991, abandoned.

[51] Int. Cl.[5] ..... E04H 4/14

[52] U.S. Cl. ..... 4/491; 137/624.15; 137/625.24; 137/637.3; 405/79

[58] Field of Search ..... 137/625.24, 637.3, 637.5, 137/624.13, 624.15; 4/491; 405/79

[56] References Cited

U.S. PATENT DOCUMENTS

| | | | |
|---|---|---|---|
| 1,354,522 | 10/1920 | Takada | 137/637.3 |
| 2,319,347 | 5/1943 | Reed | 137/625.24 |
| 2,490,509 | 12/1949 | Carleton | 137/625.24 X |
| 2,491,429 | 12/1949 | Thomas | 637/637.3 |
| 2,880,760 | 4/1959 | Widell et al. | 137/624.15 |
| 3,069,025 | 12/1962 | Winkler et al. | 137/624.13 X |
| 3,316,846 | 5/1967 | Bender | 137/624.15 X |
| 3,699,872 | 10/1972 | Kruger . | |
| 3,941,154 | 3/1976 | Bishop | 137/624.15 |
| 4,290,153 | 9/1981 | Kockerols et al. | 405/79 X |
| 4,558,474 | 12/1985 | Bastenhof . | |
| 4,676,272 | 6/1987 | Jackson . | |
| 4,812,077 | 3/1989 | Raike | 4/491 X |
| 4,986,307 | 1/1991 | Hardee . | |
| 4,989,631 | 2/1991 | Harbin . | |

FOREIGN PATENT DOCUMENTS

| | | | |
|---|---|---|---|
| 1115056 | 12/1955 | France | 137/637.3 |

*Primary Examiner*—Gerald A. Michalsky
*Attorney, Agent, or Firm*—Kevin R. Kepner

[57] ABSTRACT

A wave generating system for a wave pool utilizing a rotary valve to control the pneumatic flow to the wave generator. A rotary sleeve valve particularly adapted to high volumetric, relatively low pressure applications wherein a plurality of concentric sleeves rotatably located within a valve body provide for both porting adjustment and directional flow of the media. External control devices allow for adjustment of the porting and the timing of the directional flow by means of simple variable speed rotating devices such as an electric motor. The construction of the valve creates a very durable, strong unit which particularly avoids breakage and reliability problems associated in wave pool controls.

12 Claims, 8 Drawing Sheets

WAVE GENERATING SYSTEM

This is a continuation in part of copending application Ser. No. 07/749,134, filed Aug. 26, 1991, now abandoned.

BACKGROUND OF THE INVENTION

This invention relates to a wave generating system utilizing a rotary sleeve valve for use in applications where there is a high volumetric flow and relatively low pressure and more particularly to a rotary sleeve valve for use in wave generating systems for water park wave pools.

A relatively recent phenomena in the entertainment industry has been the advent of the water park wave pool. These pools generally consist of a swimming pool with a deep end and a sloping floor surface to a shallow end. Chambers located in the deep end of the pool are open underwater and sealed above the water surface. By alternatingly pressurizing the chambers or caissons and then exhausting the chamber a wave pattern can be formed on the surface of the pool water.

The pressurization and exhausting of the caisson is usually accomplish by pumping air into the chamber and then exhausting the chamber by means of a swinging door type valve. All of the currently used valves require some sort of linear actuator in the form of an air or hydraulic cylinder operate the valve door. These systems require an air or hydraulic pump and a control circuit to effect proper operation of the valve. Additionally, the swinging gate type valves are very susceptible to breakage.

The present invention eliminates the need for the swinging gate type valve and its associated pneumatic or hydraulic circuit. Due to its design it is also far more durable than the currently used swinging gate valves.

There are some applications of rotary type valves as U.S. Pat. Nos. 4,986,307 to Hardee, and 4,989,631 to, Harbin but neither of these type valves are suited to the high volume necessary for the instant application. There are also know several air deflectors or distributors such as those shown in the U.S. Pat. Nos. 4,676,272 Jackson and 3,699,872 to Krugar but these are more on the order of air deflectors for use in home heating and ducting systems. A wave generating systems. A wave generating systems utilizing flapper valves is disclosed in U.S. Pat. No. 4,558,474 to Bastenhof.

The present invention is designed to operate in a high volume, relatively low pressure media flow environment such as that described in the wave pool application. Other potential uses include water filter systems for large swimming and recreation pools.

DETAILED DESCRIPTION OF THE INVENTION

Figure 1:
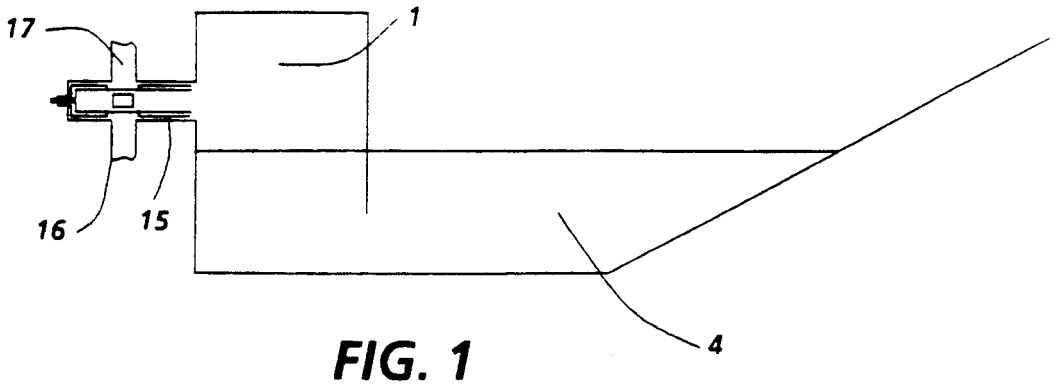
FIG. 1 is a side schematic view of a wave pool at rest.
Figure 2:
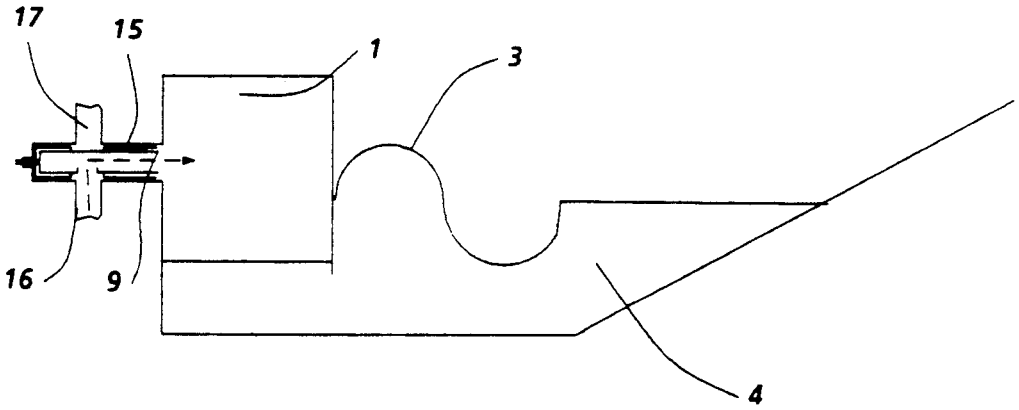
FIG. 2 is a side schematic view of a wave pool during the caisson charge cycle.
Figure 3:
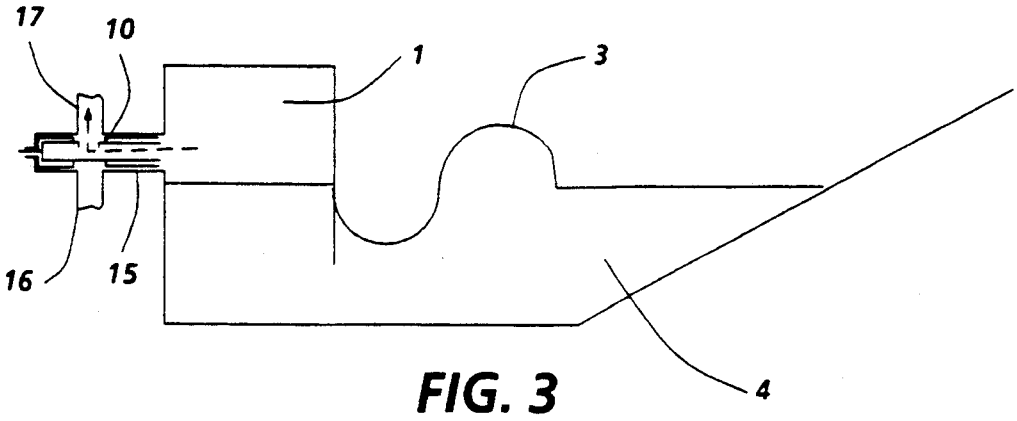
FIG. 3 is a side schematic view of a wave pool during the caisson exhaust cycle.

FIG. 1 indicates a wave pool 4 at its quescent state. FIG. 2 shows the caisson 1 during the charge cycle lowering the water level 2 in the caisson 1 with the resultant rise in level 3 outside the caisson 1. FIG. 3 shows the caisson exhaust cycle which causes the water level 2 inside the caisson 1 to rise thereby lowering the pool level 3 outside of the caisson 1. The sequential charging and exhausting of the caisson 1 in a pool 4 is what creates the desired wave action.

Figure 4:
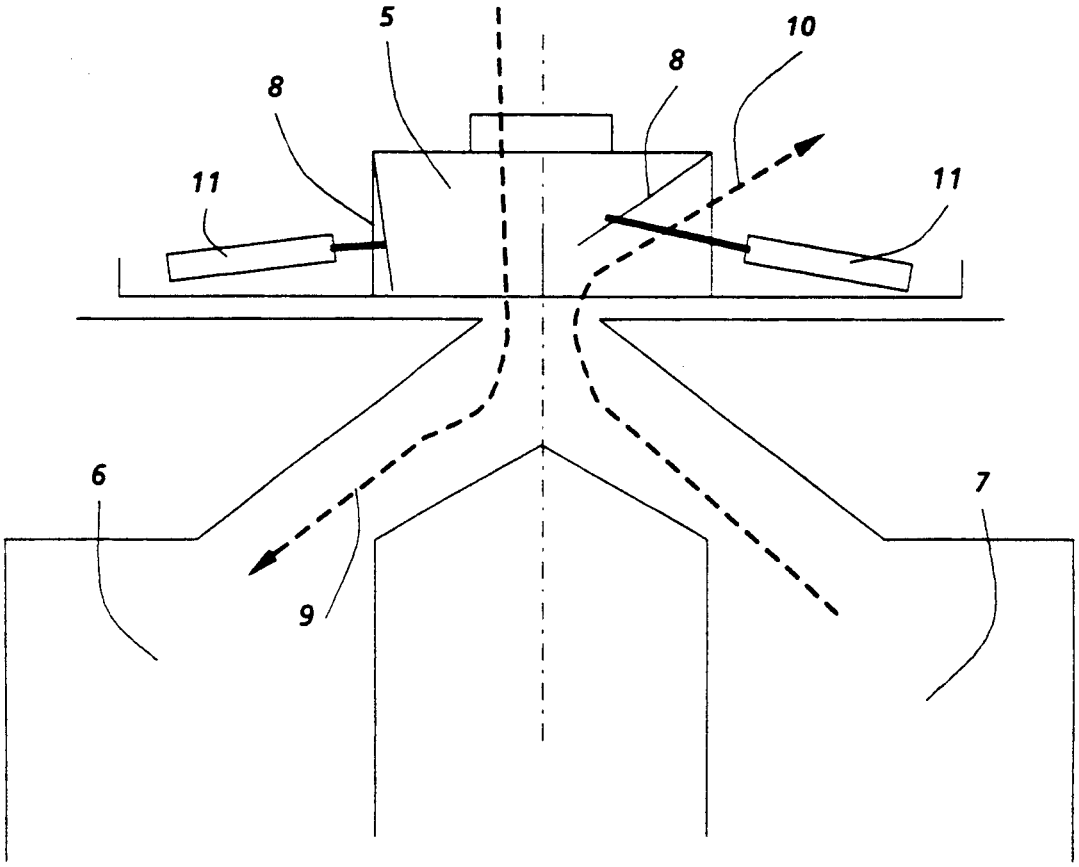
FIG. 4 (Prior Art)
FIG. 4 is a schematic view of the prior art valve for a wave pool.

FIG. 4 shows the current application of swinging gate, air or hydrauically activated valves 5 on adjacent caissons 6 and 7. A door 8 on each side of the valve 5 alternately opens and closes allowing caissons 6 and 7 to be charged and exhausted. Each door 8 is controlled by a linear activator or cylinder 11.

Figure 5A:
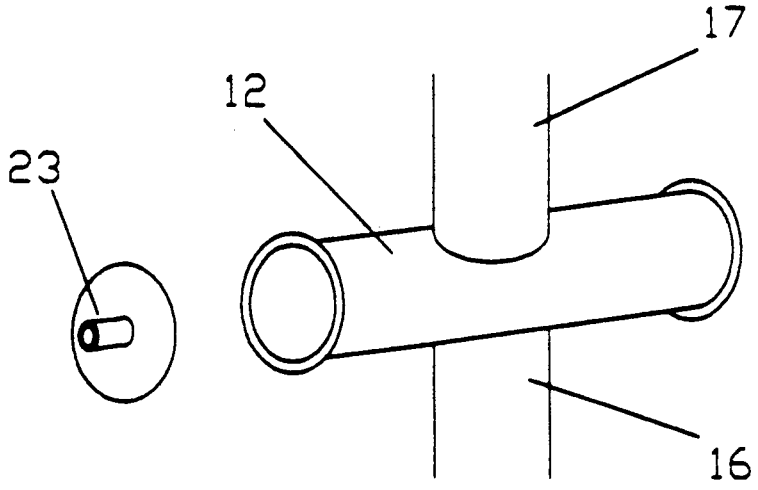
FIG. 5*a*, 5*b*, 5*c* are perspective views of the components of the present invention.
Figure 5B:
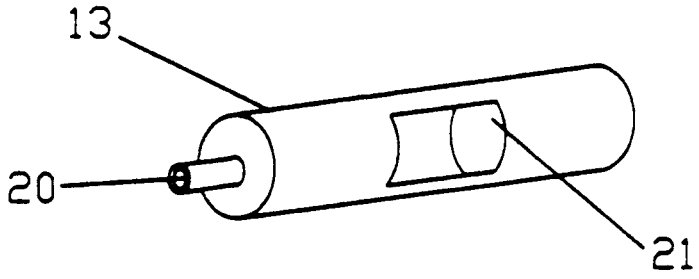
Figure 5C:
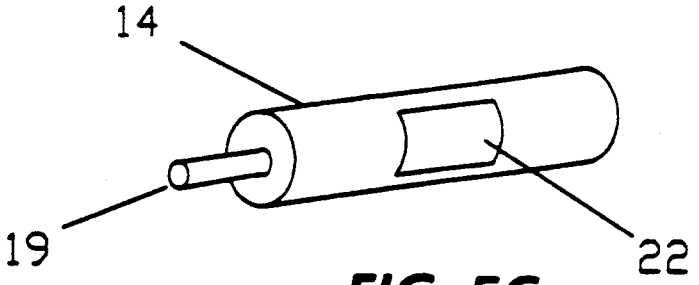
Figure 6:
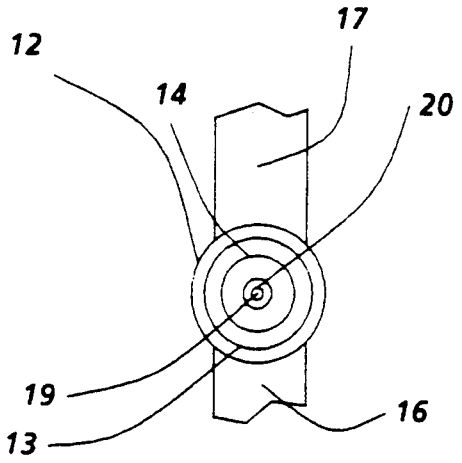
FIG. 6 is an end view of the present invention
Figure 7:
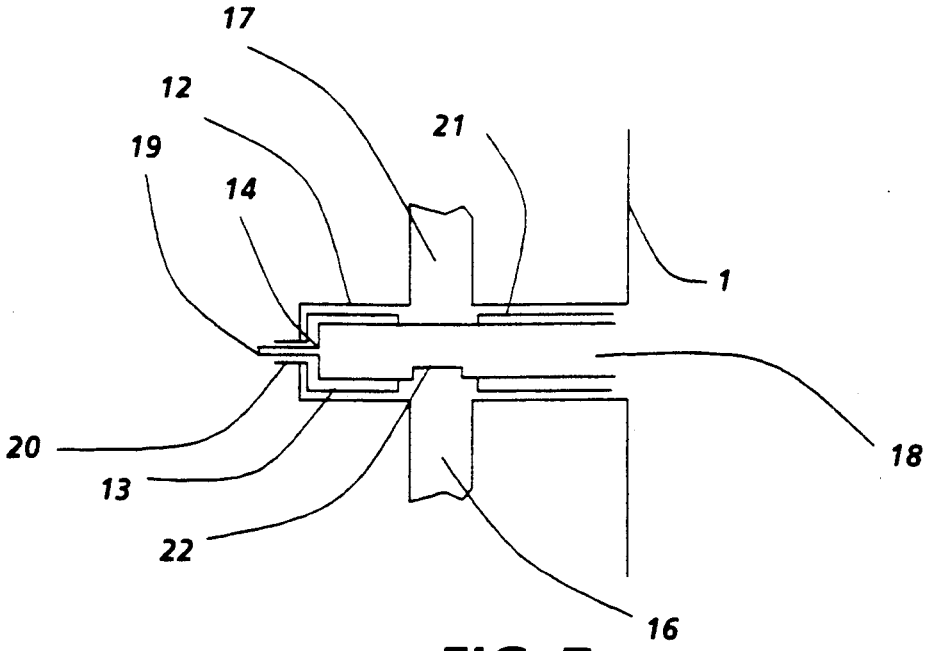
FIG. 7 is a sectional view along line A—A' of FIG. 6 showing an enlarged view of the circled portion of FIG. 2.

FIGS. 5*a*, 5*b*, 5*c* show the components of the present invention consisting of the valve body 12, the port sleeve 13 and the valve rotor 14. FIG. 6 shows an end view of the assembled valve 15, while FIG. 7 is a sectional view showing the valve body 12, port adjustment sleeve 13 and valve rotor 14 assembly.

In operation there is an air inlet 16 and outlet 17 located on the valve 15. The open end 18 of the valve 15 is connected to the caisson chamber 1. The valve rotor control stem 19 and the port adjustment sleeve stem 20 extend out of the valve 15 through the cover 23 at the end opposite the caisson connection 18.

The port adjustment sleeve 13 can be rotated by the control stem 20 so that the inlet 16 and/or outlet port 17 of the valve body 12 can be constricted by the opening 21 in the wall of the sleeve 13. As the valve rotor 14 is rotated and the opening 22 in the rotor wall aligns with the inlet port 16 air is forced into the caisson 1. As the rotation of the rotor 14 continues, the opening 22 in the wall then aligns with the outlet port 17 thereby exhausting the caisson 1.

The configuration shown in FIG. 1 also provides an added safety feature of quickly calming a wave pool in the event of an emergency. By means of a preset switch a lifeguard could cause all valves to operate to the calm position and wave action would be quickly halted.

The valve rotor of the present invention can be rotated by a variable speed electric motor or air turbine. Several valves can be set up so that the proper charge/exhaust sequence is obtained and all valves then rotated from a single source thereby eliminating the need for complex air and/or hydraulic circuitry and controls.

Figure 11:
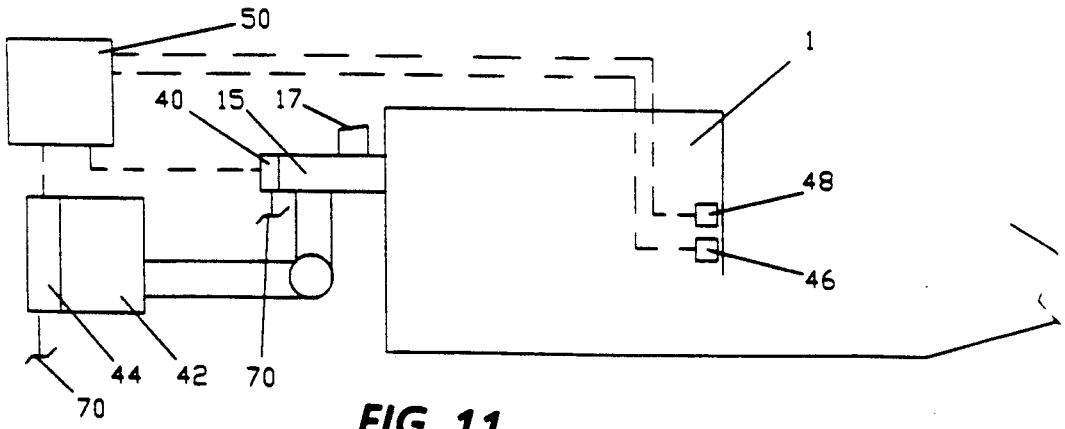
FIG. 11 is a side elevation of FIG. 10.
Figure 12:
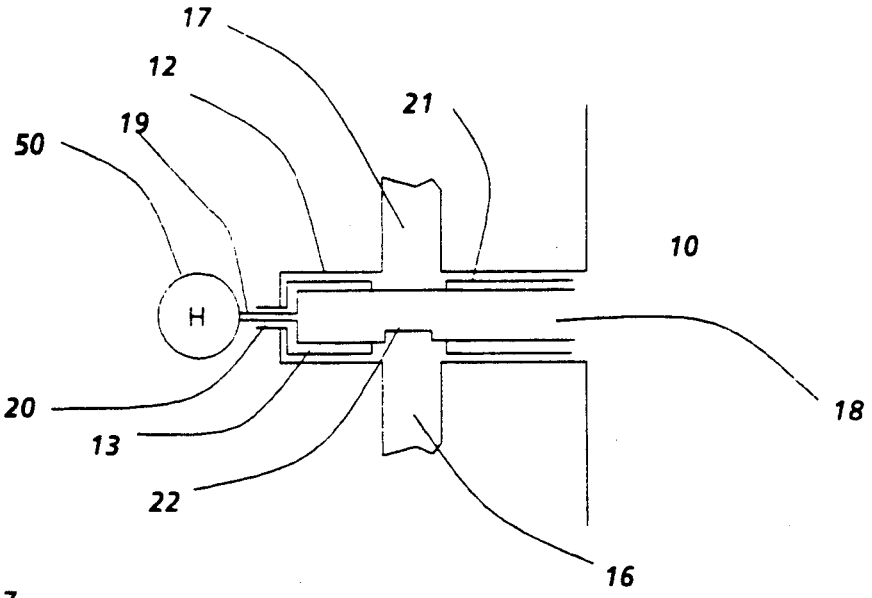
FIG. 12 is a sectional view of the FIG. 7 valve illustrating a hydraulic motor rotating drive source.
Figure 13:
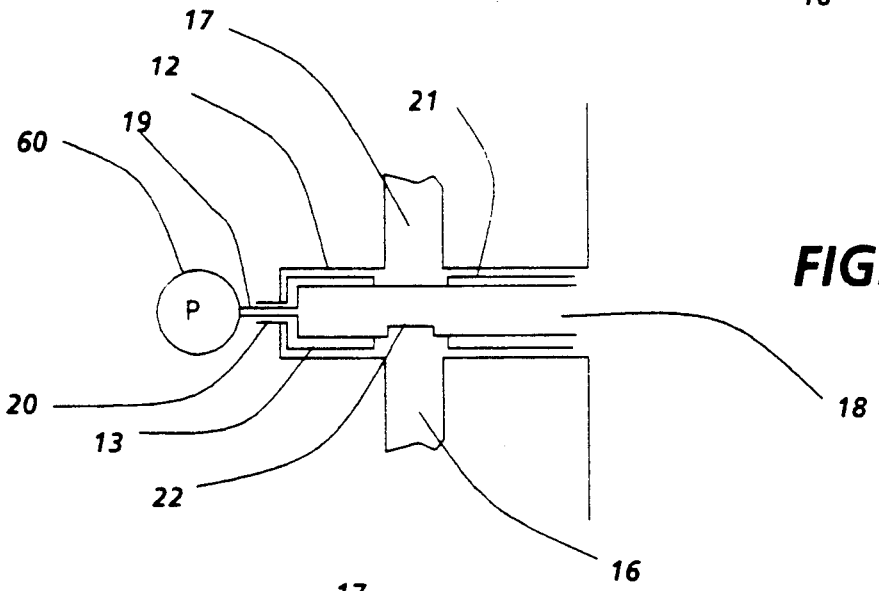
FIG. 13 is a sectional view of the FIG. 7 valve illustrating a pneumatic motor rotating drive source.

Turning now to FIGS. 11 and 12 the layout of the wave generating control system utilizing the rotary sleeve valves 15 is illustrated. The valves 15 are connected to the caisson 1 and to an air supply source 16. Each valve 15 also has an exhaust port 17. The air supply is provided by fan 42 driven by motor 44. Each rotory valve 15 is driven by a motor 40. In the present example all motors are electric and supplied power from outside source 70. Obviously pneumatic 60 (FIG. 13) or hydraulic 50 (FIG. 12) power supplies could also be utilized to drive the motors.

The system controller 50 which can be a simple relay circuit device or a more complex microprocessor is used to control the wave system. Based upon feedback from water level detection probes 46 and 48 the controller 50 maintains the valve rotation in sequence to produce the desired wave effect. A two caisson system is shown here for example only. A larger number of caissons can be used to produce a wave pattern in various size and shaped pools. The emergency lifeguard switch 52 is also connected to the controller to place all valves in the stop position to quickly quiet the wave action. The stop position closes both the inlet and outlet ports to prevent any flow into or out of the caisson.

Figure 14:
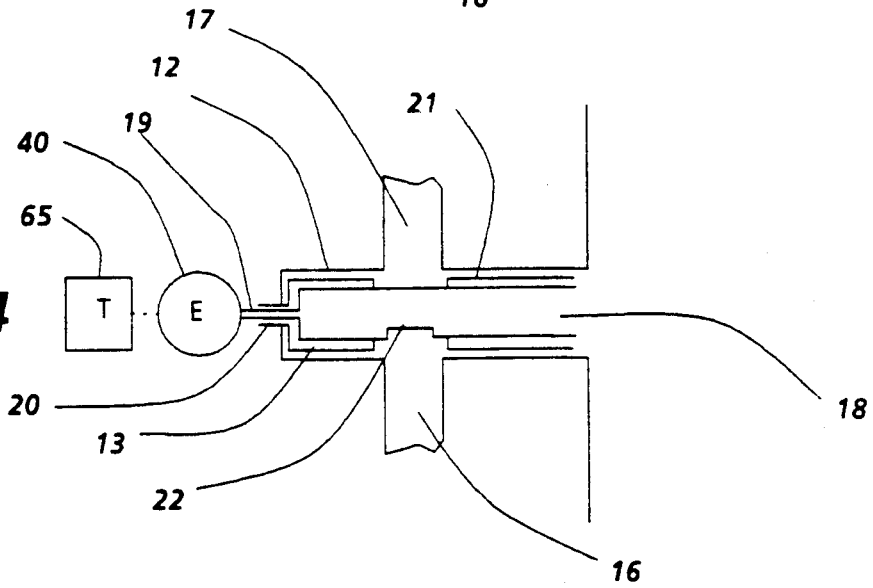
FIG. 14 is a sectional view of the FIG. 7 valve illustrating a timing mechanism with an electric motor rotating drive source.

Other control systems are capable of being utilized with the rotary valves herein. A timing system 65 (FIG. 14) can be used which maintains a certain relationship between the various valves. Altering the speed of rotation and/or sequence of valve operation enables variation of wave height and pattern. Computer control of either level detection or valve rotation timing can be implemented to allow real time adjustments of the system based on changing conditions.

It is possible to utilize the pool water itself as the medium for wave generation by causing water flow through the valves in a timed and/or sensed sequence.

Figure 8:
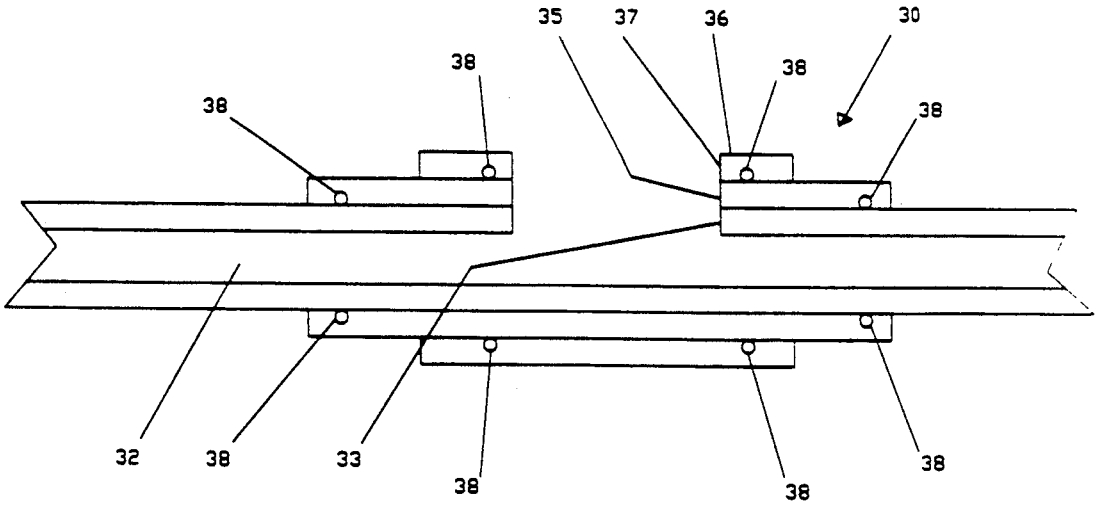
FIG. 8 is a sectional elevational view showing a second embodiment of the present invention.
Figure 9:
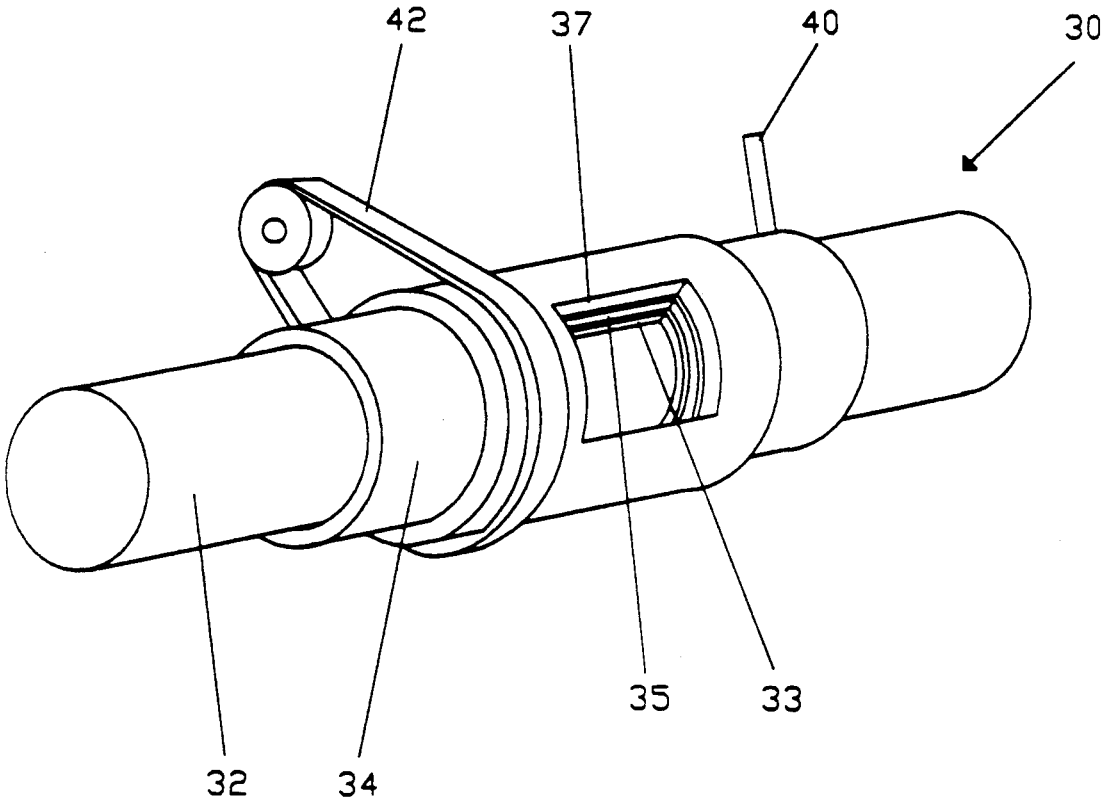
FIG. 9 is a perspective view showing a second embodiment of the present invention.
Figure 10:
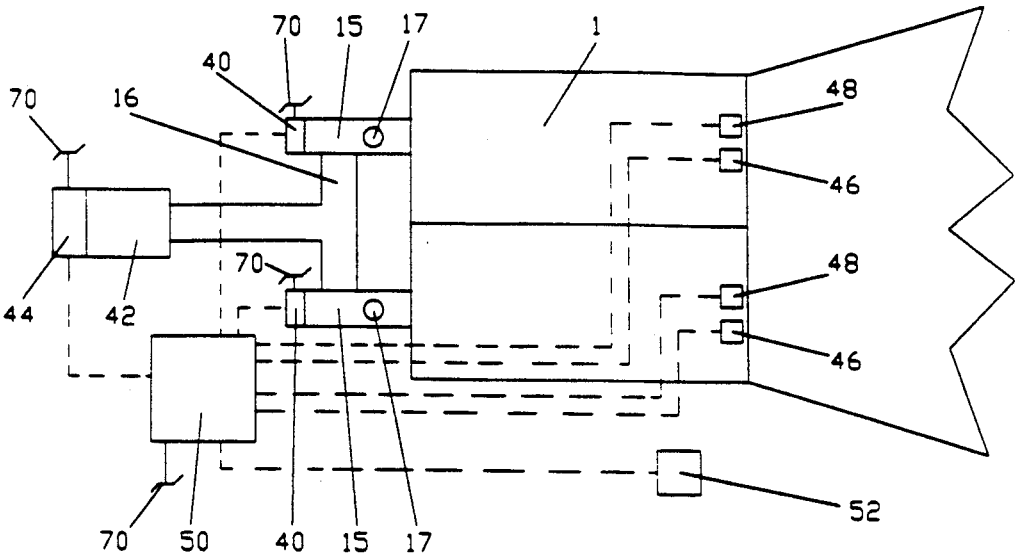
FIG. 10 illustrates a top view of a two caison chamber pool employing the control system for the preferred system.

FIGS. 8 and 9 illustrate a valve 30 with a tubular valve body 32 having an opening 33 and concentric external port sleeve 34 having an opening 35 and valve sleeve 36 having an opening 37 which are rotatably adjustable to achieve the desired flow media distribution. Media seals 38 are provided to prevent leakage between the port sleeve 34 and valve body 32 and the port sleeve 34 and valve sleeve 36. The port sleeve 34 is adjusted by means of a handle 40 or other adjusting device and the valve sleeve 36 can be driven by an external belt 42 or other known drive apparatus.

Since certain changes in the foregoing disclosure are readily apparent without departing from the scope of the invention herein described, the foregoing disclosure is intended to be construed in an illustrative sense and not in any manner a limiting sense.

What is claimed is:

1. A wave generator for a pool which includes a caisson wave generating chamber, comprising;

a valve body defining a bore, said valve body having an inlet opening, and an outlet opening;

a tubular port sleeve with a closed end rotatably located within said bore in said valve body, wherein one end of said bore of said valve body is closed and said closed end of said port sleeve is adjacent to said closed bore end;

a tubular rotor defining an axial media flow path with a closed end rotatably located concentrically within said tubular port sleeve wherein said closed end is adjacent to said tubular port sleeve closed end and an open end operatively connected to the caisson wave generating chamber;

means for rotating said tubular rotor so as to allow the cyclical intake and exhaust of the media through said valve body; and means to control the rotation of said tubular rotor so that a cyclical flow of air is charged into and exhausted from the caisson to cause waves to be generated on the pool surface.

2. A device as in claim 1 wherein;

said tubular port sleeve is disposed with a plurality of openings in the walls of said sleeve, which said openings are in substantial alignment with said valve body inlet opening and said valve body outlet opening;

said tubular rotor is disposed with at least one opening in the wall of said rotor, which said opening is in substantial axial alignment with said valve body inlet opening and said valve body outlet opening.

3. A device as in claim 2 wherein;

external rotation adjustment means for said tubular port sleeve is provided;

external rotation adjustment means for said tubular rotor is provided.

4. A device as in claim 3 wherein;

said external adjustment means for said tubular port sleeve comprises an axially disposed hollow shaft securely fixed to said tubular port sleeve closed end and extending axially through said closed bore end;

said external adjustment means for said tubular rotor comprises a shaft securely fixed to said closed end of said tubular rotor and axially disposed within said tubular port sleeve adjustment means and extending axially beyond said tubular port adjustment means.

5. The wave generator of claim 1 wherein said means for rotating said tubular rotor comprises an electric motor.

6. The wave generator of claim 1 wherein said means for rotating said tubular rotor comprises a hydraulic motor.

7. The wave generator of claim 1 wherein said means for rotating said tubular rotor comprises a pneumatic motor.

8. The wave generator of claim 1 wherein said means to control the rotation comprises a timing mechanism adapted to send a signal to said means for rotating.

9. A wave generator for a pool, comprising:

a valve body defining a bore, said valve body having an inlet opening, and an outlet opening;

a tubular port sleeve with a closed end rotatably located within said bore in said valve body, wherein one end of said bore is closed and said closed end of said port sleeve is adjacent to said closed bore end.

a tubular rotor defining an axial media flow path with a closed end rotatably located concentrically within said tubular port sleeve wherein said closed end is adjacent to said tubular port sleeve closed end;

means for rotating said tubular rotor so as to allow the cyclical intake and exhaust of the media through said valve body; and means to control the rotation of said tubular rotor, wherein said means to control the rotation comprises a pool media level sensor adapted to generate a signal indicative of the pool level and a programmable controller adapted to receive the signal from said level sensor and to generate and send a control signal to said means for rotating responsive thereto.

10. The wave generator of claim 9 wherein said means for rotating said tubular rotor comprises an electric motor.

11. The wave generator of claim 9 wherein said means for rotating said tubular rotor comprises a hydraulic motor.

12. The wave generator of claim 9 wherein said means for rotating said tubular rotor comprises a pneumatic motor.

* * * * *